US008061518B2

(12) United States Patent
Shaughness

(10) Patent No.: US 8,061,518 B2
(45) Date of Patent: Nov. 22, 2011

(54) BRUSH COVER

(76) Inventor: Brigitte Shaughness, Grand Cayman (KY)

( * ) Notice: Subject to any disclaimer, the term of this patent is extended or adjusted under 35 U.S.C. 154(b) by 0 days.

(21) Appl. No.: 12/941,522

(22) Filed: Nov. 8, 2010

(65) Prior Publication Data

US 2011/0108444 A1 May 12, 2011

Related U.S. Application Data

(60) Provisional application No. 61/258,697, filed on Nov. 6, 2009.

(51) Int. Cl.
*B65D 83/10* (2006.01)

(52) U.S. Cl. ..... 206/361; 206/1.5; 206/818

(58) Field of Classification Search ..... 206/361, 206/362.2, 362.3, 15.2, 15.3, 1.5, 818
See application file for complete search history.

(56) References Cited

U.S. PATENT DOCUMENTS

| | | | | |
|---|---|---|---|---|
| 1,498,302 | A * | 6/1924 | Satake | 206/15.3 |
| 2,262,753 | A * | 11/1941 | Brennan | 206/209 |
| 5,511,654 | A * | 4/1996 | de la Rocha | 206/15.3 |
| 7,111,354 | B2 * | 9/2006 | Nennig et al. | 15/248.1 |
| 7,207,437 | B1 * | 4/2007 | Johansson | 206/15.3 |

* cited by examiner

*Primary Examiner* — Jacob K Ackun
(74) *Attorney, Agent, or Firm* — Ulmer & Berne, LLP

(57) ABSTRACT

A protective brush cover is described for use with a makeup brush. In some versions, the protective brush cover comprises a body and a closing feature. In some versions the protective brush cover comprises a body, a lid, and a securing feature. In some versions, the body is operable to hold the head of a makeup brush, and the body may further have an opening such that the handle of the makeup brush may extend through the opening.

7 Claims, 17 Drawing Sheets

BRUSH COVER

PRIORITY

This application claims priority to U.S. Provisional Patent Application Ser. No. 61/258,697, filed Nov. 6, 2009, entitled "Protective Brush Cover," the disclosure of which is incorporated by reference herein in its entirety.

FIELD

Versions of the present invention relate generally to protective devices, and more particularly, to covering devices for makeup applicators.

BACKGROUND

Makeup brushes are used to apply makeup, such as foundation or various other powder forms of cosmetics, and come in a wide variety of shapes, sizes, and configurations. These brushes typically come packaged in a plastic cover to enclose the bristles of the makeup brush to prevent damage to the bristles prior to sale of the brush. Before use, the plastic cover is discarded as it is generally unsuitable for later protecting the bristles of the makeup brush. The plastic cover is generally a low quality material that tightly binds the bristles of the brush during transport and prior to sale.

The included plastic cover is unsuitable to store the makeup brush after the initial use because it is very difficult to reattach the plastic cover, which also compresses the bristles of the makeup brush. Over time, repeated use of a makeup brush allows the bristles to expand, providing a better user experience because makeup can be more easily and evenly spread across the surface of the skin. Placing the makeup brush into the plastic cover recompresses the bristles and reduces the benefits of using a makeup brush with full bristles.

Previous solutions for transporting a makeup brush require the user to place the makeup brush in a larger makeup bag, or resealable plastic bag, and place this large bag inside of a purse or other carrying bag. This method is generally cumbersome and undesirable because it consumes too much space within the purse or bag. Additionally, the makeup contained on the bristles may be dislodged during transport, which results in makeup covering the handle or other portions of the brush that may make the brush difficult or messy to use. The makeup brush may also collect dirt and grime during transport, which could transfer dirt and grime to the face during subsequent use. If the brush is simply placed in a purse, or other article, the brush and/or article is likely to become damaged or stained.

BRIEF DESCRIPTION OF THE DRAWINGS

While the specification concludes with claims that particularly point out and distinctly claim the invention, it is believed the expressly disclosed versions of the present invention can be understood from the following description taken in conjunction with the accompanying drawings, in which like reference numerals identify the same elements. The drawings and detailed description which follow are intended to be merely illustrative of the expressly disclosed versions and are not intended to limit the scope of the invention as set forth in the appended claims. In the drawings:

DETAILED DESCRIPTION

The following description should not be used to limit the scope of the protective brush cover. Other examples, features, aspects, versions, and advantages of the protective brush cover will become apparent to those skilled in the art from the following description. As will be realized, the protective brush cover is capable of other different and obvious aspects, all without departing from the protective brush cover as described herein. Accordingly, the drawings and descriptions should be regarded as illustrative in nature and not restrictive. It should therefore be understood that the inventor contemplates a variety of versions that are not explicitly disclosed herein.

Figure 1:
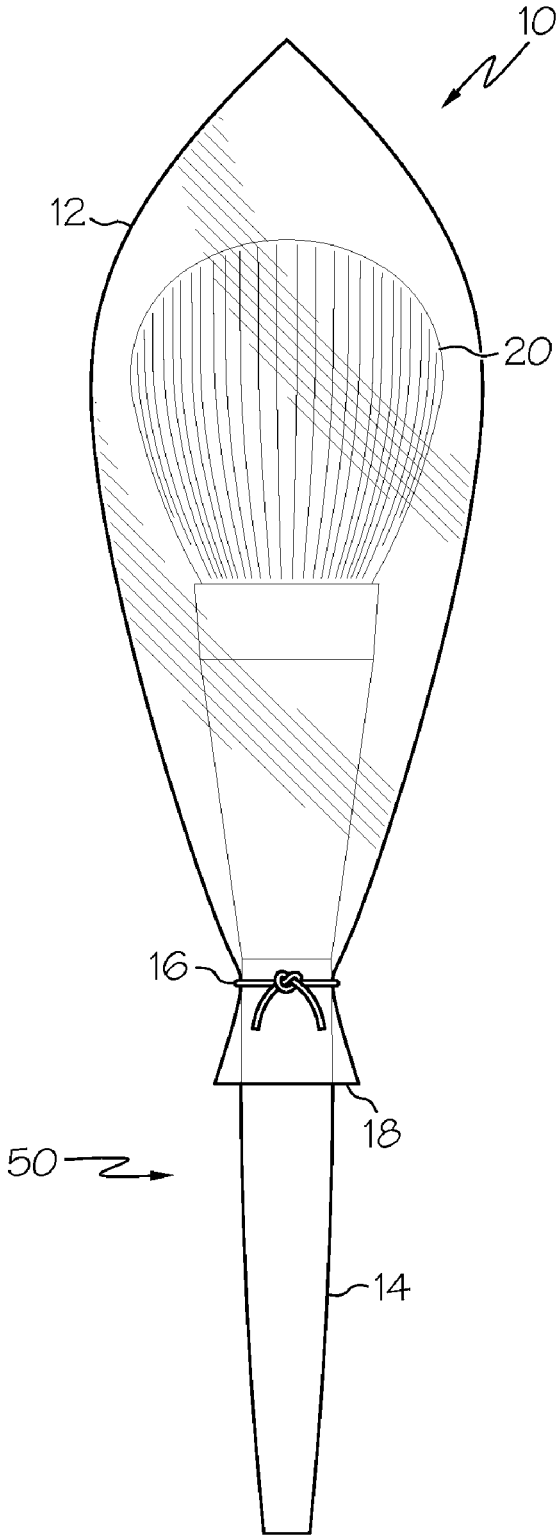
FIG. 1 depicts a top view of a version of a protective brush cover with a makeup brush.
Figure 2:
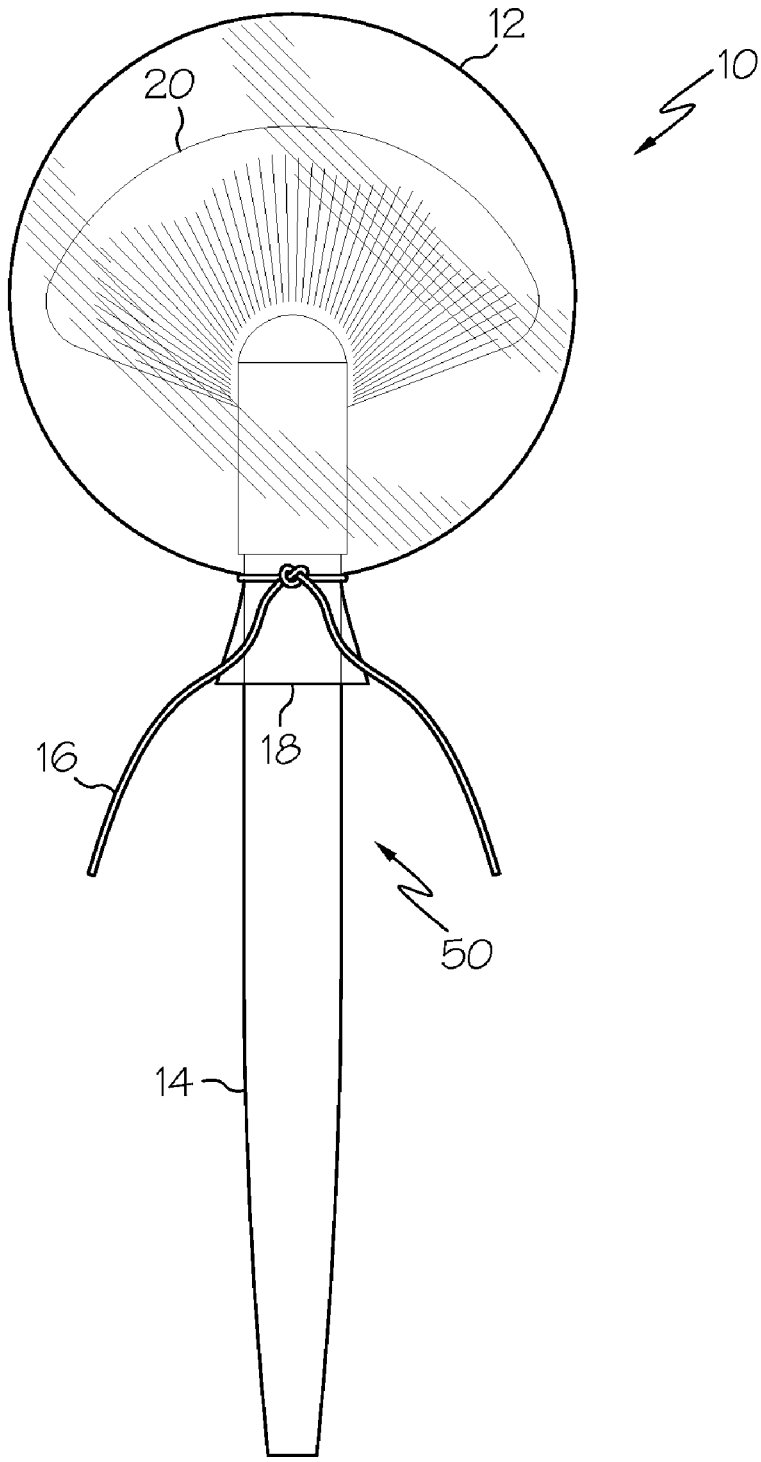
FIG. 2 depicts a top view of an alternative version of a protective brush cover with a makeup brush.

In FIG. 1, a version of a protective brush cover (10) is shown. The protective brush cover (10) may generally comprise a pouch (12), an opening (18), and a tying feature (16). Protective brush cover (10) may be used with a makeup brush (50) having bristles (20) and a shaft (14).

Pouch (12) and opening (18) may be configured to receive bristles (20) of makeup brush (50). The shape of pouch (12) may be generally round. In other versions, the shape of pouch (12) may be cone shaped, cylindrical shaped, triangle shaped, rectangle shaped, square shaped, or any other suitable shape for receiving makeup brush (50) so as to minimize compressing bristles (20) of makeup brush (50).

Figure 3:
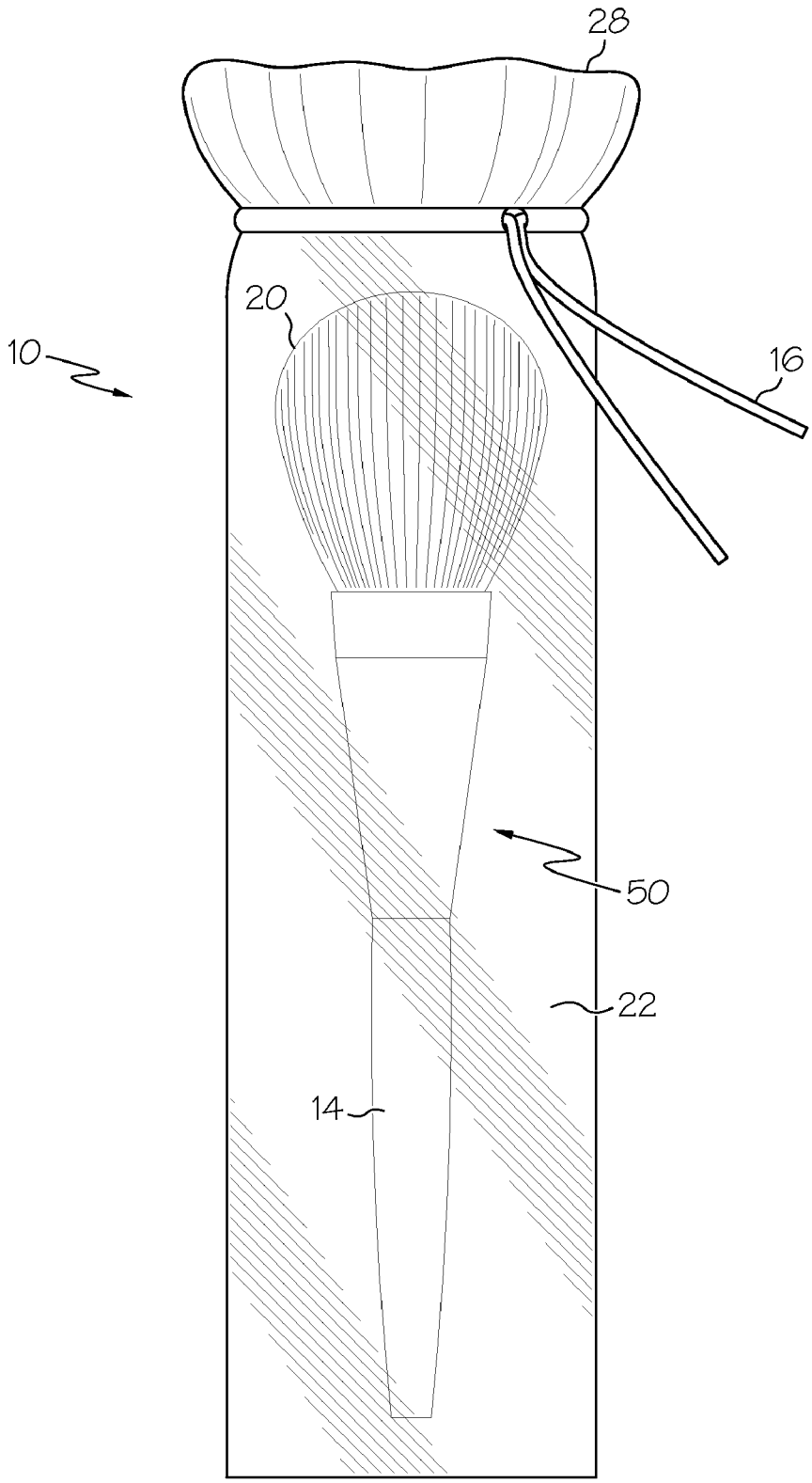
FIG. 3 depicts a top view of another alternative version of a protective brush cover with a makeup brush.
Figure 4:
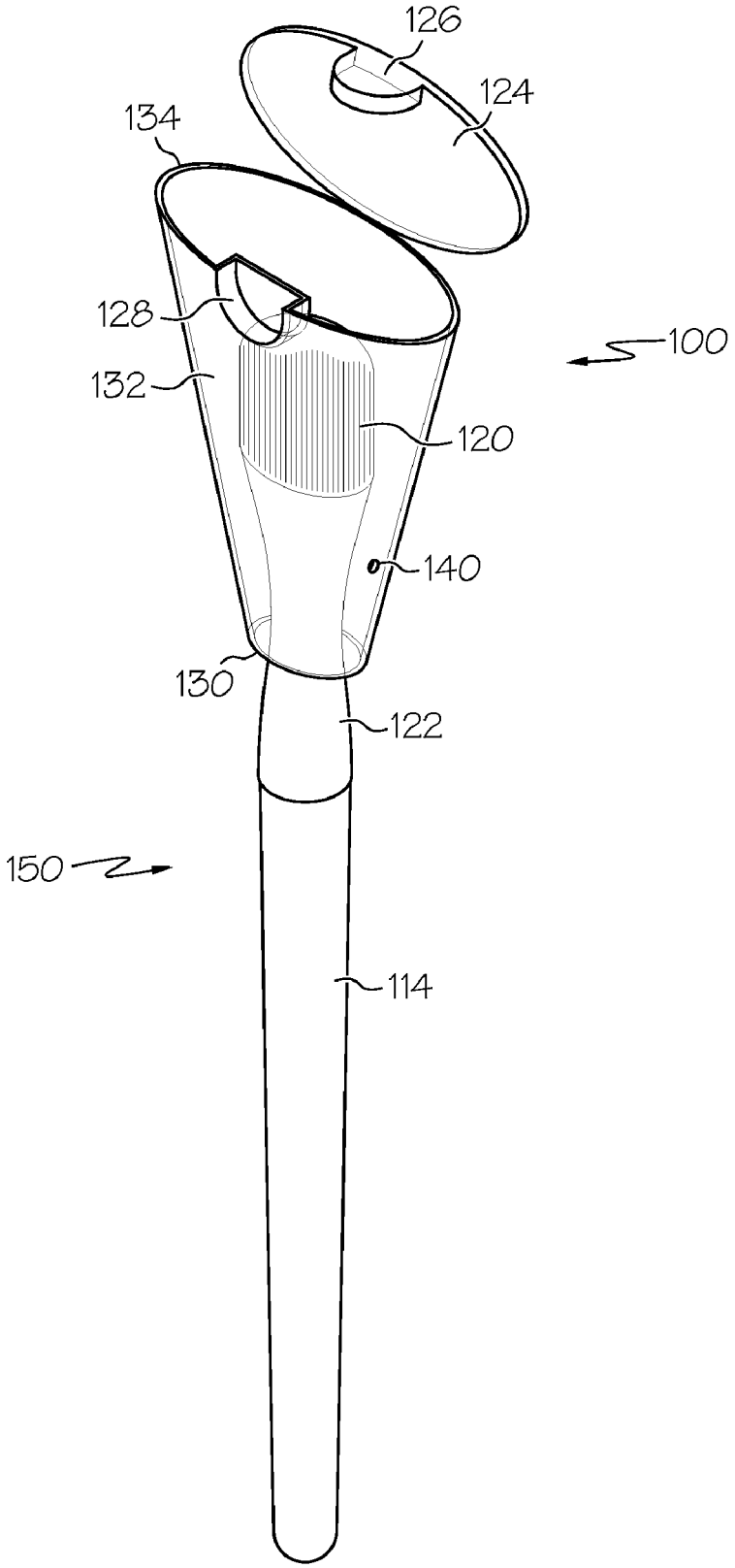
FIG. 4 depicts a perspective view of another alternative version of a protective brush cover with a makeup brush.
Figure 5:
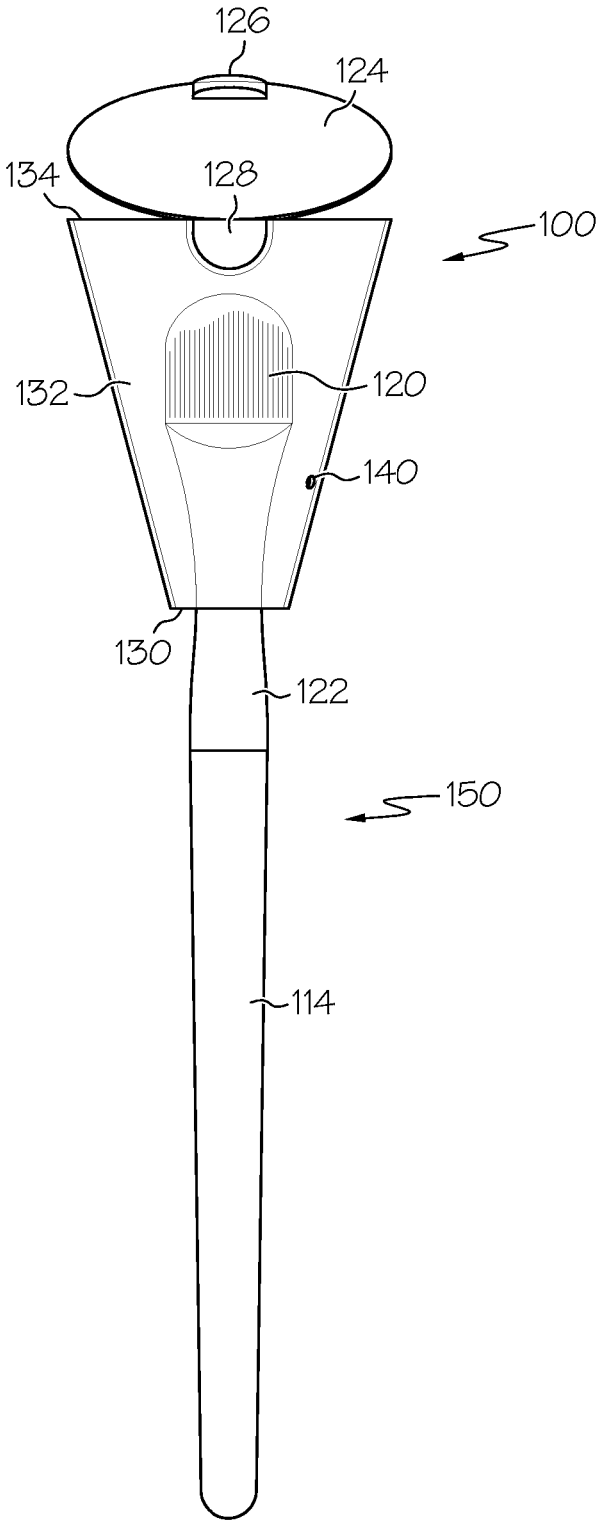
FIG. 5 depicts a front view of the protective brush cover of FIG. 4.
Figure 6:
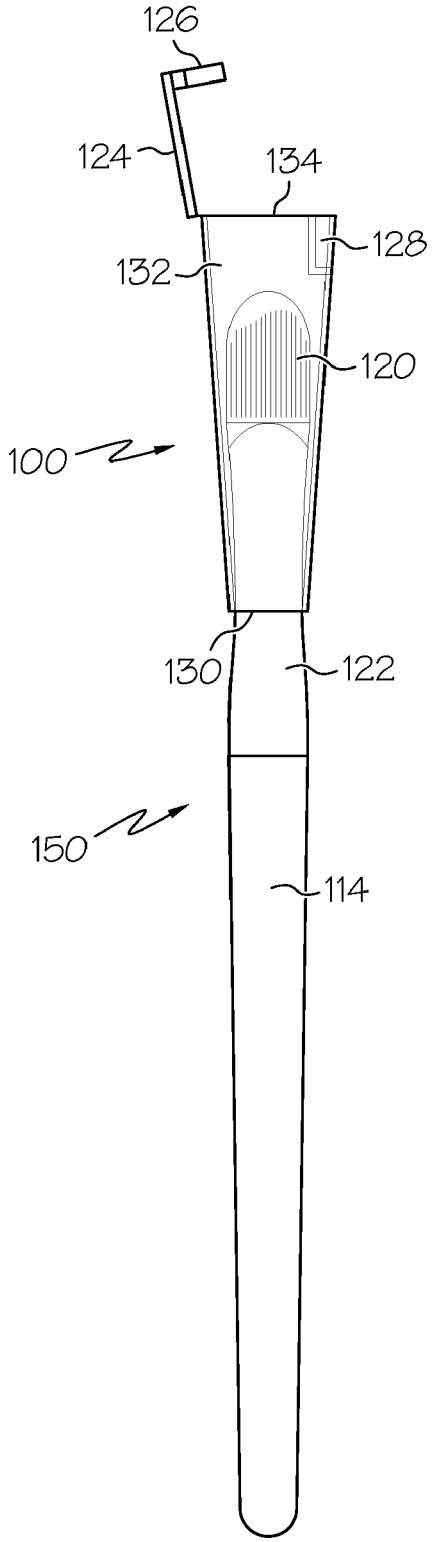
FIG. 6 depicts a side view of the protective brush cover of FIG. 4.
Figure 7:
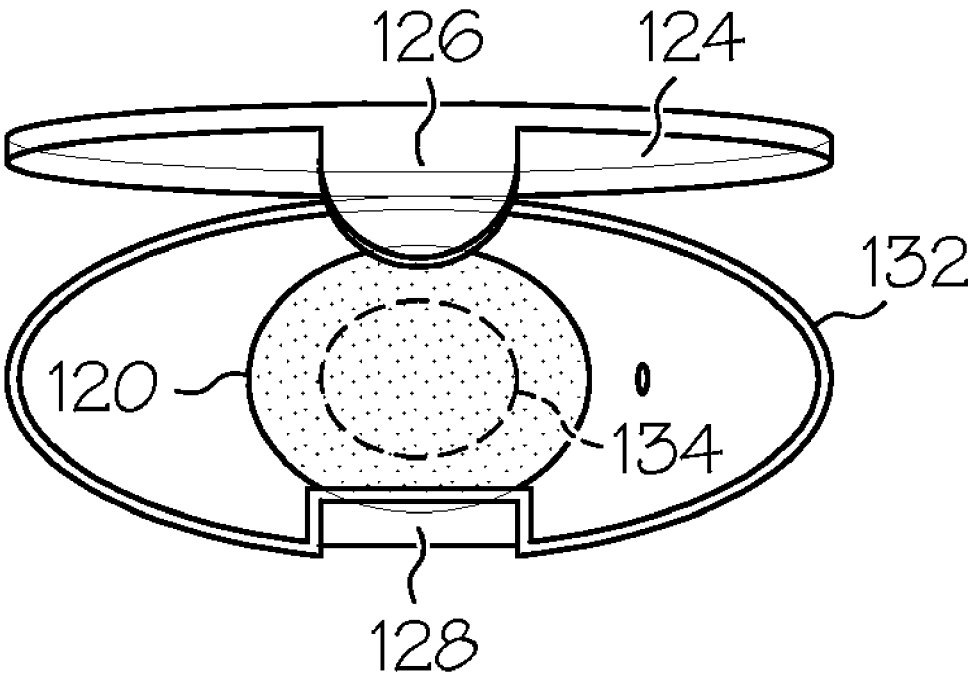
FIG. 7 depicts a top view of the protective brush cover of FIG. 4.

Pouch (12) may be various sizes as well. Pouch (12) may be of a size to cover bristles (20) of makeup brush (50) without substantially covering shaft (14) of makeup brush (50). In an alternative version, as shown in FIG. 3, pouch 22 may be of a size sufficient to cover the entire makeup brush (50).

Further, pouch (12) may be of a size and shape to protect bristles (20) of makeup brush (50) while minimizing the overall size of makeup brush (50) and protective brush cover (10) to reduce obtrusiveness in a purse or bag. Pouch (12) may be of a size and shape specifically designed to enclose a particular make and model makeup brush (50). Other suitable shapes and sizes of pouch (12) will be apparent to those of ordinary skill in the art in view of the teachings herein.

The material of pouch (12) may be a soft fabric material. Furthermore, the material of pouch (12) may be rigid or stiff. A flexibly rigid material may be used to allow pouch (12) to maintain shape when placed in a purse or other bag to protect bristles (20) of makeup brush (50). The material of pouch (12) may be selected from any suitable material including, but not limited to, cotton, nylon, polyester, denim, satin, wool, leather, cashmere, linen, felt, silk, velvet, organza, plastic, and vinyl. The material of pouch (12) may also be washable so that pouch (12) may be washed after multiple uses to remove makeup and other dirt from pouch (12). Further, the material of pouch (12) may comprise an antibacterial material.

Pouch (12) may comprise various colors and patterns. Suitable colors and patterns may be selected so that when placed in a purse or other bag, protective brush cover (10) is highly visible to allow quick retrieval. Suitable colors and patterns may be selected for other aesthetic reasons. Other suitable colors and patterns of pouch (12) will be apparent to those of ordinary skill in the art in view of the teachings herein.

The opening (18) of pouch (12) of protective brush cover (10), in versions where the make-up brush is inserted through a bottom opening (18) of the pouch (12), may be of a size suitable to allow the bristle end of a makeup brush to enter. Opening (18) of pouch (12) may be opened and closed through use of a tying feature (16). By manipulating tying feature (16), opening (18) of pouch (12) may have two positions: an open position and a tightened position. In the open position, opening (18) of pouch (12) may be sufficiently large enough to allow bristle (20) end of makeup brush (50) to be easily placed into or removed from pouch (12) of protective brush cover (10).

In the tightened position, opening (18) of pouch (12) may substantially tighten or snuggly tighten around shaft (14) of protective brush cover (10). The tightened position may be sufficiently tight so as to prevent unintentional removal of makeup brush (50) from protective brush cover (10). The tightened position may also be sufficiently tight so that protective brush cover (10) stays on makeup brush (50) when makeup brush (50) is placed inside a purse or other bag. Other suitable sizes of opening (18) of pouch (12) will be apparent to those of ordinary skill in the art in view of the teachings herein.

Tying feature (16) may be configured to work with opening (18) of pouch (12) of protective brush cover (10) to change the size of opening (18). The tying feature (16) may comprise at least one drawstring that may be pulled or loosened to change the size of the opening (18). Tying feature (16) may further comprise a single drawstring or may comprise a plurality of drawstrings. Upon changing the size of opening (18), the drawstring or plurality of draw strings may be wrapped around protective brush cover (10) or may be allowed to freely hang. An additional tightening feature (not shown), such as, for example, a bead may be used to maintain the open or the tightened position of tying feature (16). Other suitable methods or configurations to tighten or loosen opening (18) of pouch (12) may be used as well. For example, tying feature (16) may comprise, but is not limited to, one or more clasps, rubber bands, flexible wires, ribbon, etc., suitable to manipulate the size or shape of opening (18) of pouch (12) of protective brush cover (10).

In one version, the user may use protective brush cover (10) by placing the brush through opening (18) of protective brush cover (10) and into pouch (12). Then the user may engage tying feature (16) to tighten opening (18) of protective brush cover (10). The user may then place protective brush cover (10) in the user's purse or other bag for storage or transport. In an alternative version, the user may place makeup brush (50) in protective brush cover (10) and may place the covered makeup brush (50) in a purse, a makeup bag, or other bag without manipulating tying feature (16).

The user may then transport or store the covered makeup brush (50) in the purse or other bag. The user may remove the covered makeup brush (50) from the purse or other bag. The user may remove makeup brush (50) from protective brush cover (10) by loosening tying feature (16) or by simply removing the brush from protective brush cover (10) without manipulating tying feature (16).

FIGS. 4-9 depict another version of a protective brush cover (100) for use with a makeup brush (150). Makeup brush (150) comprises a handle (114) and a head (120). Protective brush cover (100) comprises a body (132) and a lid (124). Body (132) is shaped to have a slightly flattened frustoconical shape with a mouth (134) and a neck opening (130). Neck opening (130) is sized wide enough such that handle (114) of makeup brush (150) may be inserted through neck opening (130) yet narrow enough that head (120) of makeup brush (150) does not slip through neck opening (130). The contours of body (132) may be sufficiently wide such that the walls do not compress or damage the bristles of head (120), yet narrow enough such that protective brush cover (100) and makeup brush (150) can be easily placed into, for example, a purse. The degree of flatness of body (132) may be shaped such that it generally tracks the contours of head (120) of makeup brush (150). For example, if makeup brush (150) is very wide or if the bristles of makeup brush (150) flare widely, body (132) may be shaped to accommodate such flare. Body (132) comprises a generally rigid material such as a cardboard or plastic. However any suitable material may be used.

Near mouth (134) of body (132), a semicircular recess (128) is formed. Recess (128) is shaped to complement the magnetic tab (126) attached to lid (124). Recess (128) may comprise a magnet or other magnetically influenced material or metal embedded beneath the surface of the recess such that when lid (124) shuts upon body (132), recess (128) and tab (126) magnetically lock together to keep lid (124) closed. The force of the magnetic bond formed between recess (128) and tab (126) may generally be strong enough such that lid (124) is not inadvertently opened, for example, during transport, but weak enough such that a user may easily open lid (124) by decoupling magnetic bind between recess (128) and tab (126). While recess (128) and tab (126) comprise a complementary semi circular shape, any suitable shape for recess (128) and tab (126) may be used as would be apparent to one of ordinary skill in the art in view of the teachings herein. Furthermore, a vent hole (140) is positioned on body (132) to provide ventilation within protective brush cover (100) while makeup brush (150) is placed in protective brush cover (100) with lid (124) closed.

Figure 8:
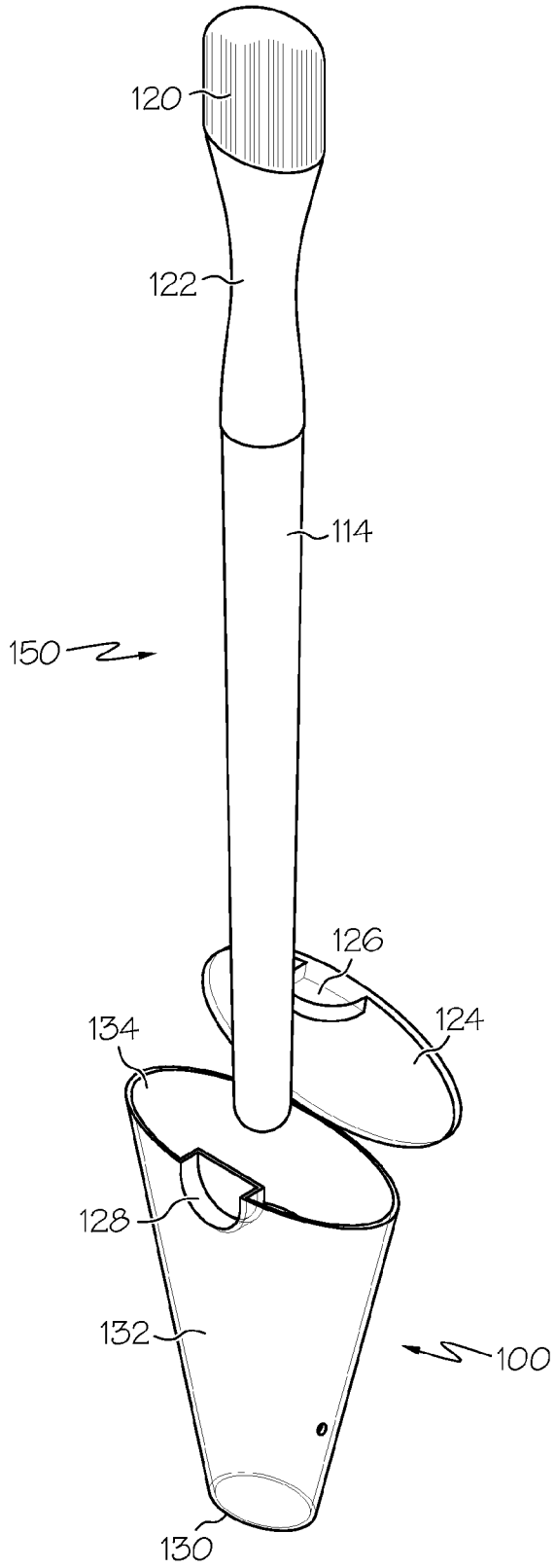
FIG. 8 depicts a perspective view of the protective brush cover of FIG. 4 with the makeup brush removed.
Figure 9:
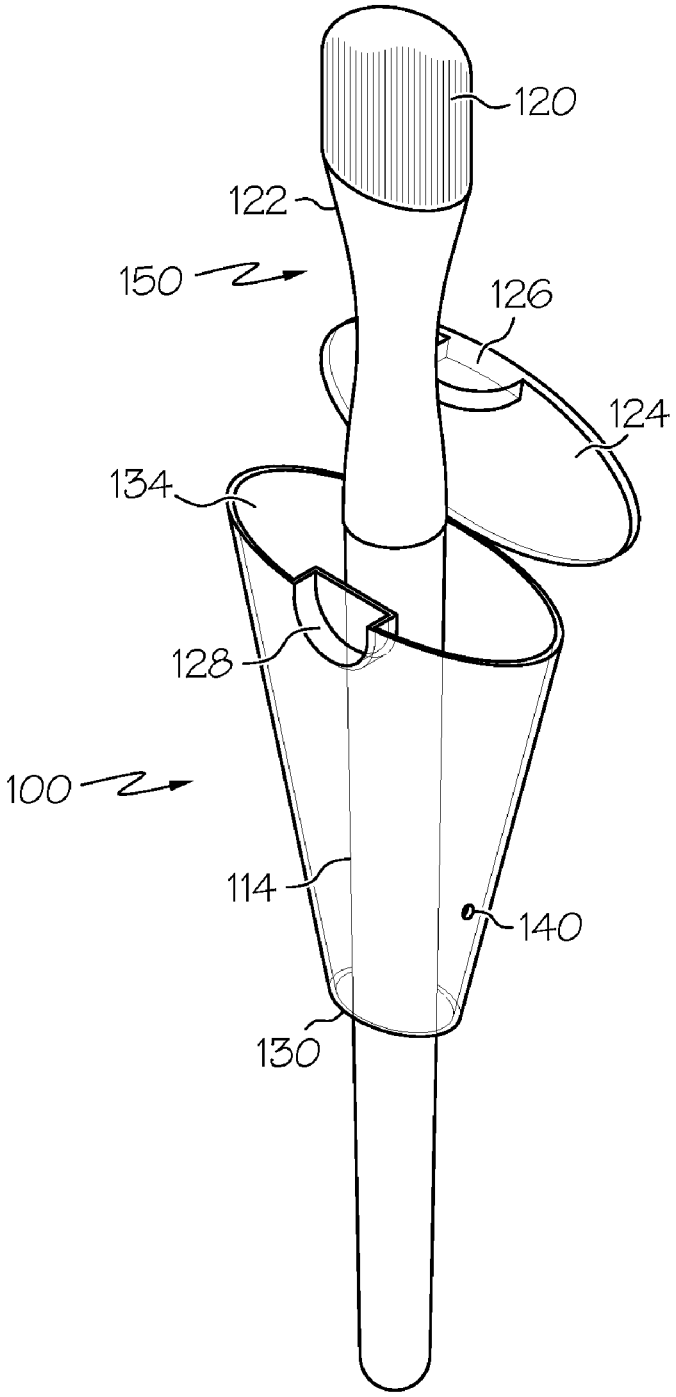
FIG. 9 depicts a perspective view of the protective brush cover of FIG. 4 with the makeup brush being inserted into the protective brush cover.
Figure 10:
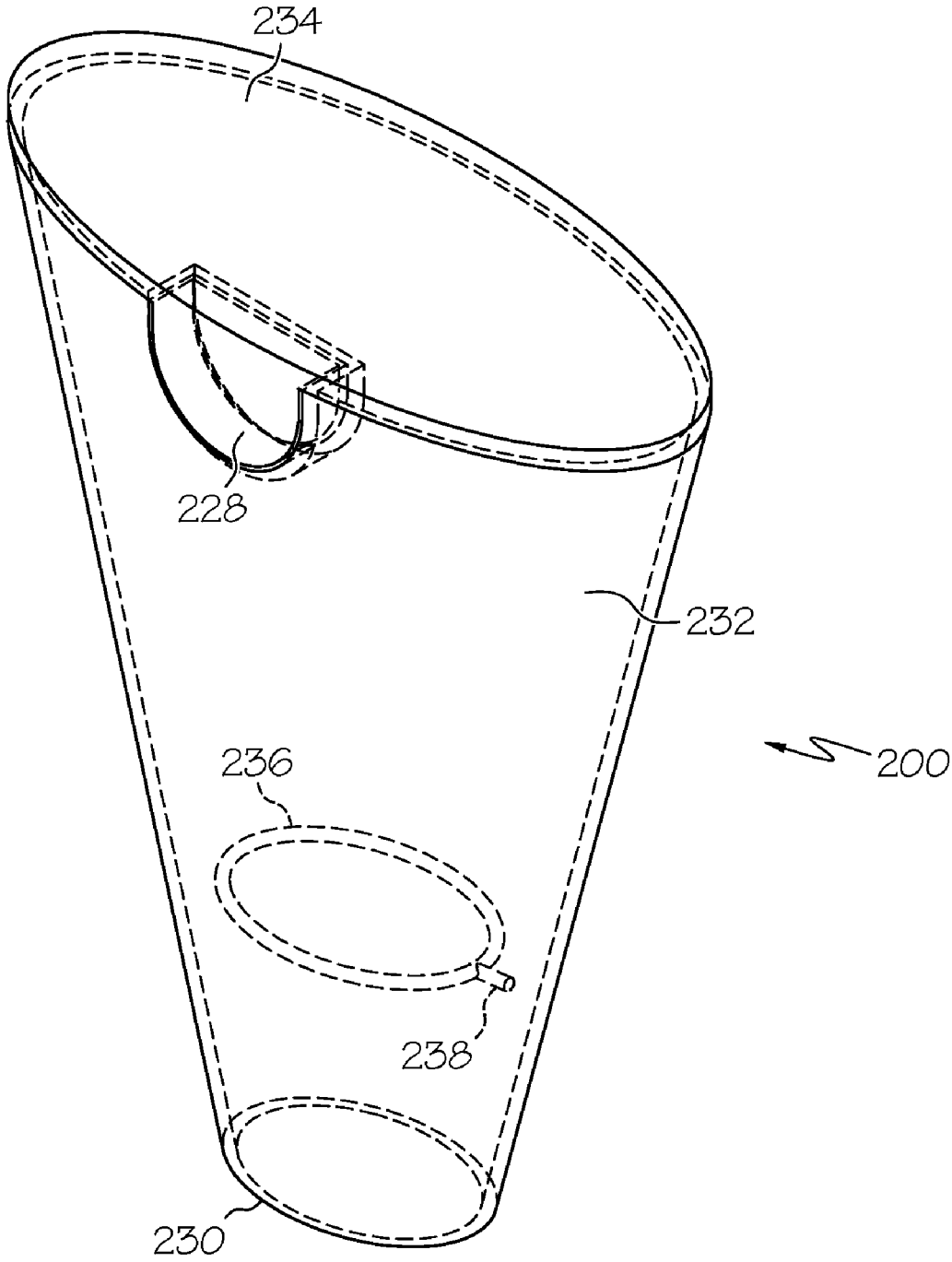
FIG. 10 depicts a perspective view of an alternative version of a protective brush cover.
Figure 11:
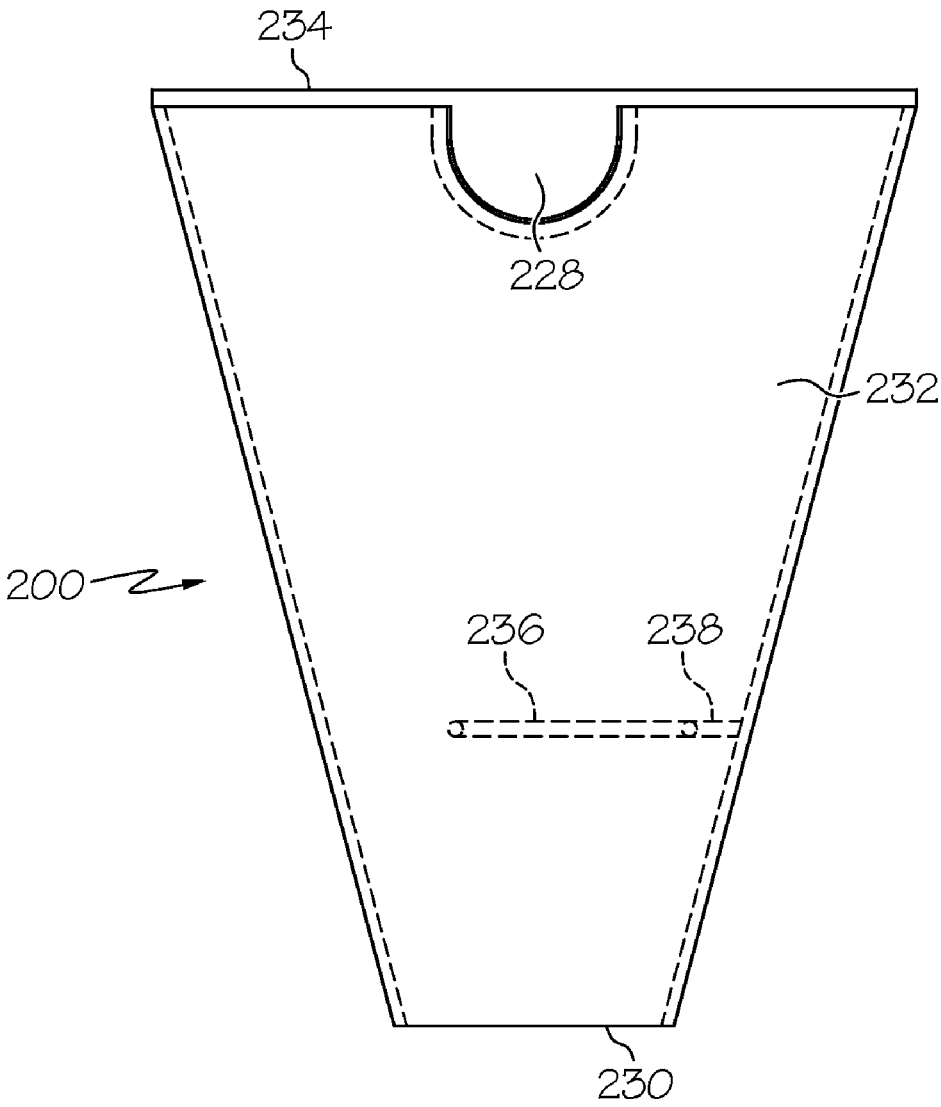
FIG. 11 depicts a front view of the protective brush cover of FIG. 10.
Figure 12:
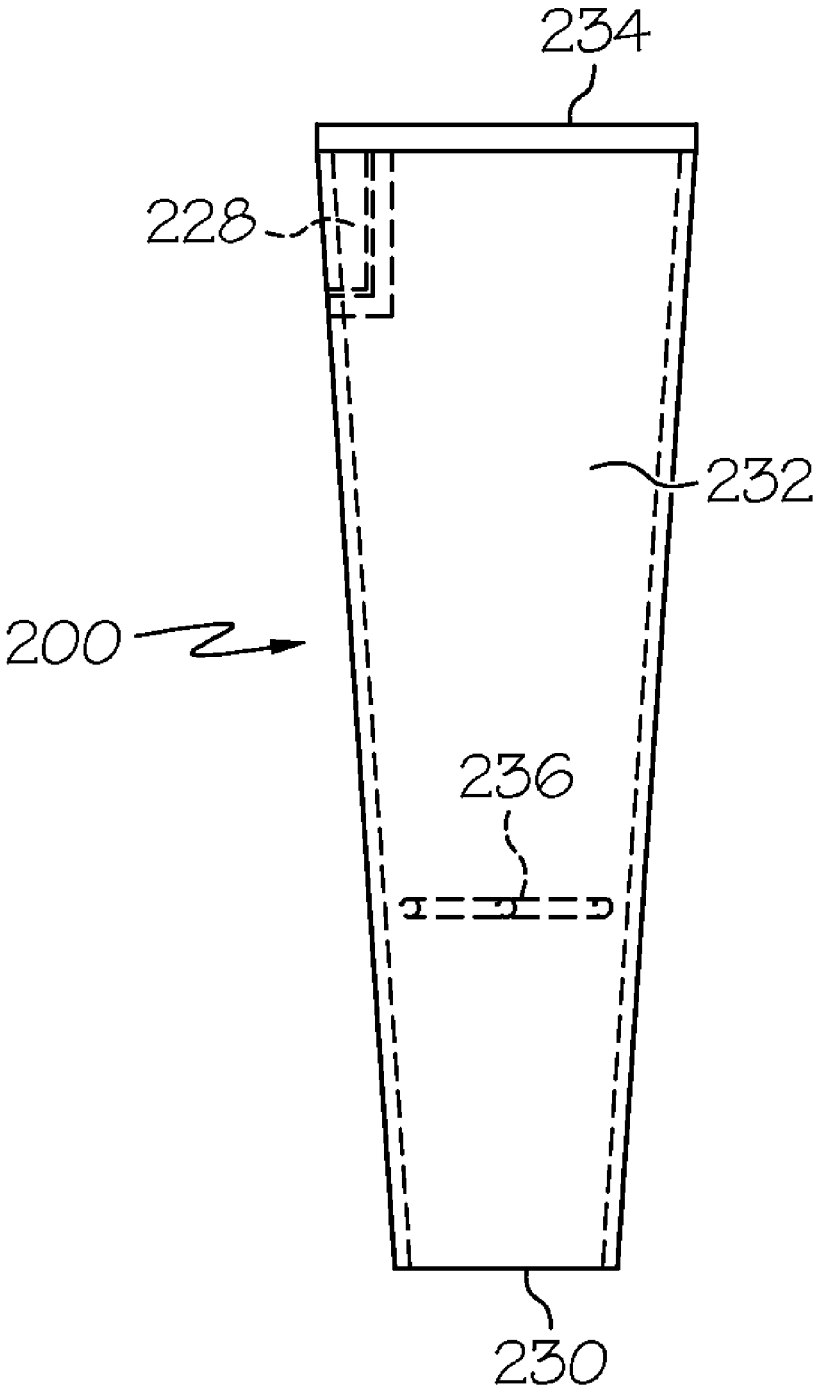
FIG. 12 depicts a side view of the protective brush cover of FIG. 10.
Figure 13:
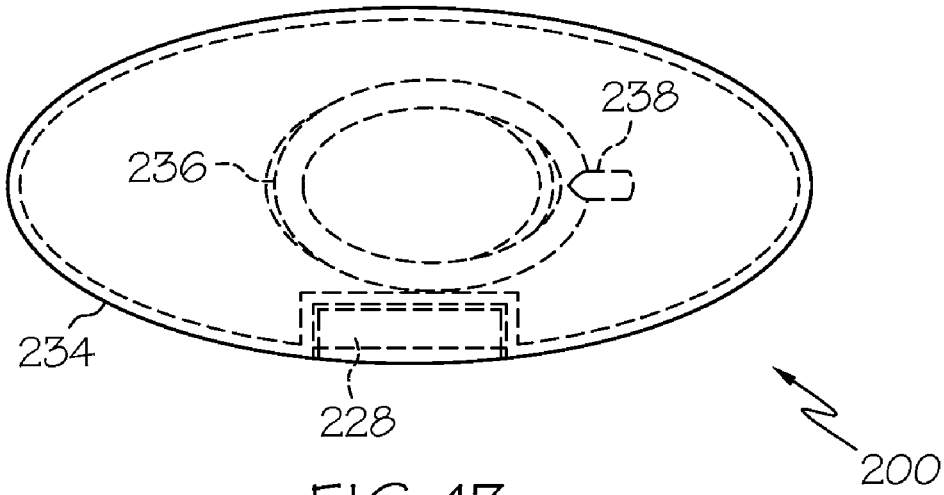
FIG. 13 depicts a top view of the protective brush cover of FIG. 10.

Generally, protective brush cover (100) may be used as shown in FIGS. 8-9. Lid (124) of protective brush cover (100) is opened and makeup brush (150) is inserted through mouth (134) of protective brush cover (100). Handle (114) of makeup brush (150) travels through neck opening (130). The taper of the portion near neck opening (130) of protective brush cover (100) aids in preventing makeup brush (150) from sliding completely through neck opening (130). Furthermore the taper of neck opening (130) enables a user to simply drop makeup brush (150) into protective brush cover (100) since the taper helps guide makeup brush (150) through neck opening. Additionally, as mentioned above, neck opening (130) may be sufficiently narrow so as to form a grip around a neck portion (122) of makeup brush (150).

Once makeup brush (150) is inserted into protective brush cover (100) such that head (120) is enclosed, the user can close lid (124) of protective brush cover (100) for transport or storage of makeup brush (150).

FIGS. 10-13 depict an alternative version of a protective brush cover (200) that is substantially similar to protective brush cover (200) shown in FIGS. 4-9 where the protective brush cover (200) comprises a body (232), mouth (234), neck opening (230), and recess (228). In the illustrated version, protective brush cover (200) comprises an interior loop (236) with a connecting portion (238) to attach interior loop (236) to body (232) of protective brush cover (200). Interior loop (236) comprises generally a wire loop able to grip the neck of a makeup brush, such as the makeup brush shown in FIGS. 4-9. It will be appreciated that interior loop (236) may provide additional stability in securing a makeup brush.

Figure 14:
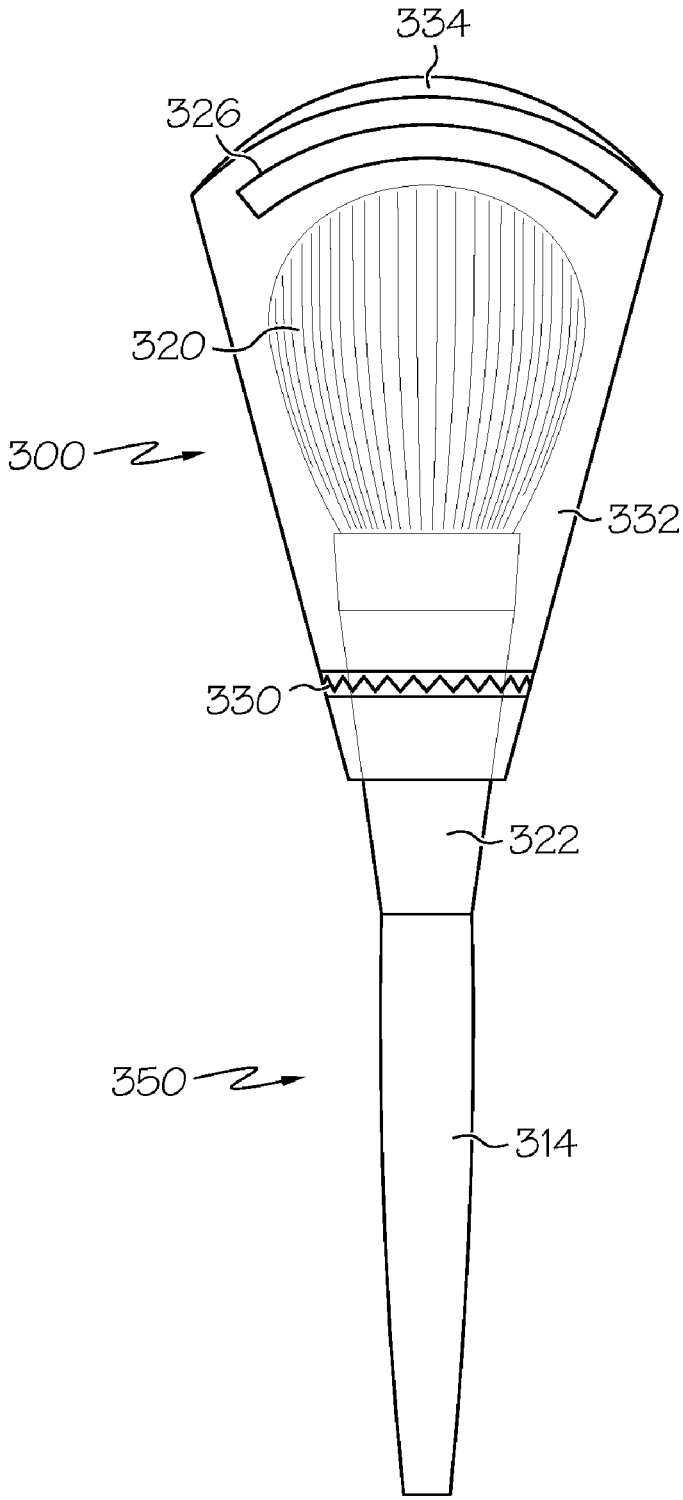
FIG. 14 depicts a front view of an alternative version of a protective brush cover having a magnetic enclosure.

FIG. 14 depicts an alternative version of a protective brush cover (300) comprising a body (332), a neck opening (330), a mouth (334) and a magnetic strip (326) for use with a makeup brush (350), which comprises a head (320), a handle (314), and a neck (322). In the illustrated version, body (332) comprises a cloth-like material. Of course, any suitable material may be used.

Magnetic strip (326) has a generally arc-like shape that matches the shape of mouth (334). A second similarly shaped magnetic strip (not shown) is positioned opposite to magnetic strip (326) such that mouth (334) may be held shut once a makeup brush (350) is placed though (334) of protective brush cover (300) by joining magnetic strip (326) with the second magnetic strip. While in this version, magnetic strip (326) and the second magnetic strip are similarly shaped, they may have different shapes, such as, for example, complementary shapes or interlocking shapes.

Neck opening (330) comprises gathered fabric material having an elastic band, rope, thread, drawstring, or liner extending circumferentially around neck opening (330) such that neck opening (330) may be opened and then tightened around a neck (322) of a makeup brush (350) once a handle (314) of makeup brush (350) is placed through neck opening (330). The tightness of neck opening (330) is sufficient such that makeup brush (350) should not slip out of neck opening (330), yet not so tight that makeup brush (350) cannot be intentionally removed from protective brush cover (300).

Figure 15:
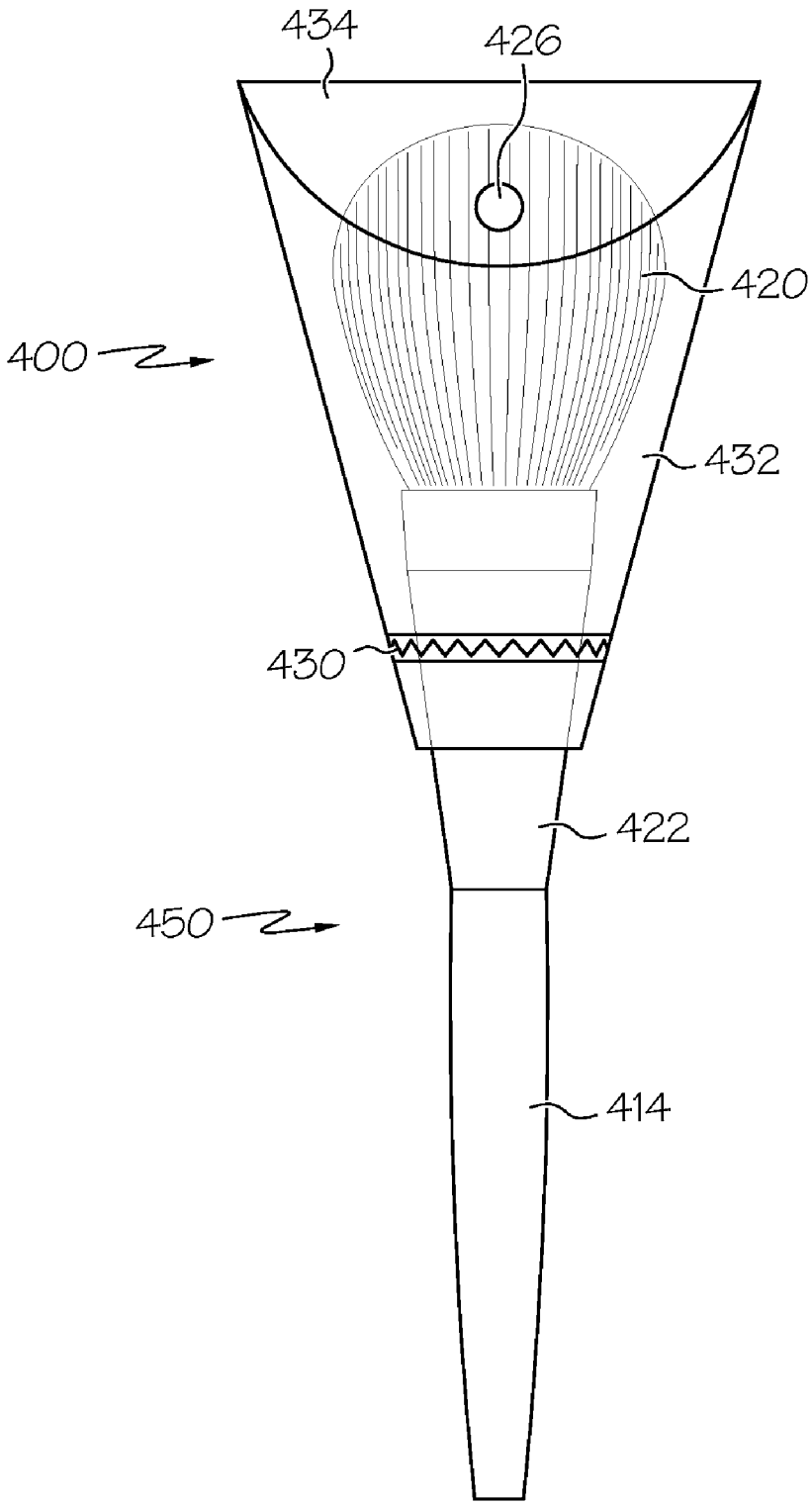
FIG. 15 depicts a front view of an alternative version of a protective brush cover having a snap fit enclosure.

FIG. 15 depicts an alternative version of a protective brush cover (400) comprising a body (432), a neck opening (430), a flap (434), and a fastener (426) for use with a makeup brush (450) having a handle (414), a neck (422) and a head (420). Flap (434) is designed to cover the mouth (not shown) of protective brush cover (400). In the illustrated version, fastener (426) comprises a snap button fit, but any suitable fastening means may be used, such as, for example, a clasp, hook, or pin.

Figure 16:
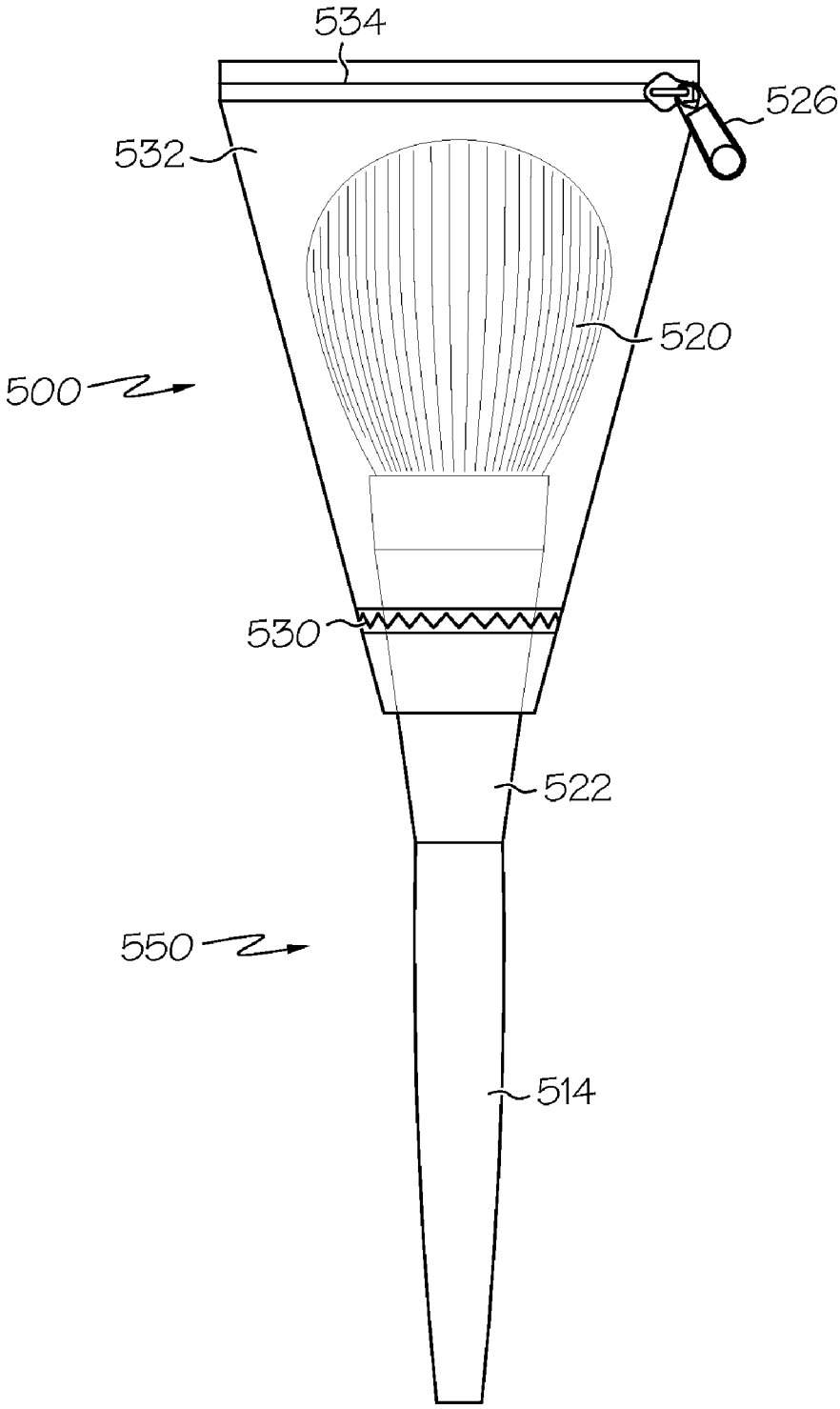
FIG. 16 depicts a front view of an alternative version of a protective brush cover having a zipper enclosure.

FIG. 16 depicts an alternative version of a protective brush cover (500) comprising a body (532), a neck opening (530), a zipper opening (534), and a zipper pull (526). Zipper pull (526) may be manipulated by a user to open and close zipper opening (534) of protective brush cover such that a makeup brush (550) having a head (520), neck (522) and handle (514) may be inserted or removed through zipper opening (534). In one version, the neck opening may remain closed where, for example, when the zipper pull (526) is actuated only a side portion of the brush cover (500) is unzipped. In this version, the handle (514) may be inserted through the neck opening, the brush (520) may be positioned within the brush cover (500), and the zipper pull (526) may then be actuated to close the brush cover (500).

Figure 17:
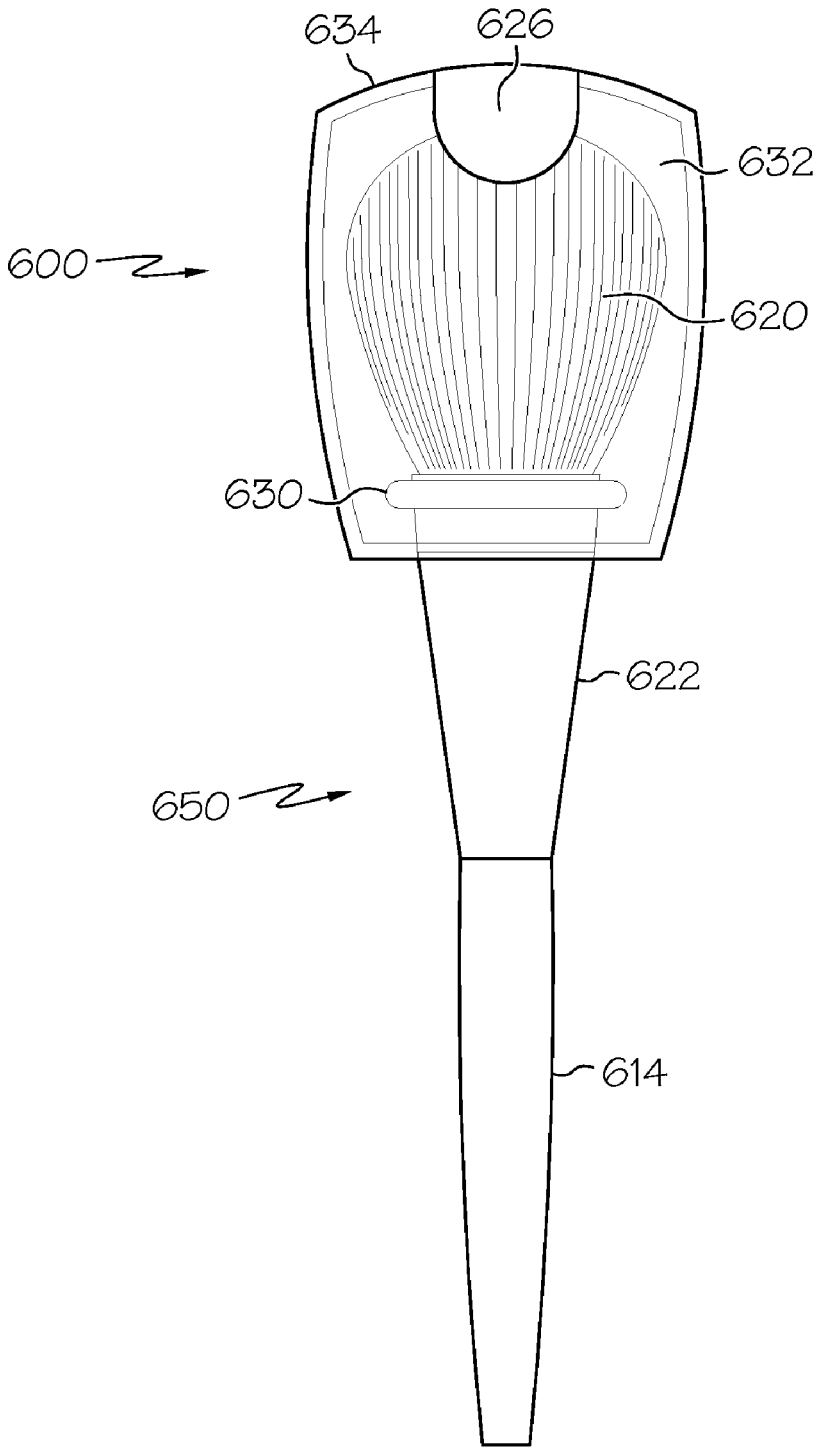
FIG. 17 depicts a front view of an alternative version of a protective brush cover having a magnetic snap lid.

FIG. 17 depicts an alternative version of a protective brush cover (600) comprising a body (632), a magnetic flap (626), and an embedded band (630) for use with a makeup brush (650) having a head (620), a neck (622), and a handle (614).

Embedded band (630) may be sized to fit a variety of different brush sizes. For example, for larger brushes, embedded band (630) may be wider or longer. Accordingly, a shorter or narrower embedded band (63) may be used for smaller brushes. Also, the illustrated version comprises a generally square-like shaped protective brush cover (600). It will be appreciated that as the length or width of embedded band (630) is selected for the appropriate size makeup brush (650), the dimensions or general shape of protective brush cover (600) may be adjusted to accommodate embedded band (630).

Magnetic flap (626) comprises a flap having a magnet embedded in the flap. Magnetic flap (626) may join with an associated element embedded in body (632) of protective brush cover (600) to close protective brush cover (600) once makeup brush (650) has been inserted.

Having shown and described various versions of the protective brush cover, further adaptations of the methods and systems described herein may be accomplished by appropriate modifications by one of ordinary skill in the art without departing from the scope of the protective brush cover. Several of such potential modifications have been mentioned, and others will be apparent to those skilled in the art. For instance, the examples, versions, geometrics, materials, steps, and the like discussed above are illustrative and are not required. Accordingly, the scope of the protective brush cover should be considered in terms of the following claims and is understood not to be limited to the details of structure and operation shown and described in the specification and drawings.

What is claimed is:

1. An apparatus comprising:

(a) a body, the body comprising a frustoconical shape having a first elliptically shaped opening and a second elliptically shaped opening, the first opening being sized to fit a handle of a makeup brush, the second opening having a larger diameter than the first opening, the first opening being sized smaller than a head of a makeup brush, the body being constructed of a rigid, form-retaining material;

(b) a lid in communication with the body through a hinge, the lid having the same shape as the second opening, the lid comprising a semicircular tab extending perpendicularly from the lid toward the body, the tab comprising a first embedded magnet, wherein the semicircular shape of the tab complements a recess embedded in the body, the recess comprising a second embedded magnet operable to couple with the first embedded magnet.

2. The apparatus of claim 1, wherein the body further comprises an interior loop positioned within the body.

3. The apparatus of claim 2, wherein the interior loop comprises a wire loop configured to grip the handle of the makeup brush.

4. The apparatus of claim 1, wherein the body further comprises a vent hole.

5. The apparatus of claim 1, wherein a magnetic bond is formed between the first embedded magnet in the tab and the second embedded magnet in the recess when the lid is in a closed position.

6. The apparatus of claim 2, wherein the magnetic bond formed between the first embedded magnet in the tab and the second embedded magnet in the recess is selectively decoupled by a user.

7. The apparatus of claim 1, wherein the body is sized to accept the makeup brush having a flare.

* * * * *